US006824026B1

(12) United States Patent
Boutwell

(10) Patent No.: US 6,824,026 B1
(45) Date of Patent: Nov. 30, 2004

(54) DEFORMABLE RESEALING CLOSURE FOR CAULKING CARTRIDGES

(76) Inventor: Steven Boutwell, 4175 Watts St., Tobaccoville, NC (US) 27050

( * ) Notice: Subject to any disclaimer, the term of this patent is extended or adjusted under 35 U.S.C. 154(b) by 25 days.

(21) Appl. No.: 10/341,274

(22) Filed: Jan. 14, 2003

(51) Int. Cl.[7] ..... B67D 3/00
(52) U.S. Cl. ..... 222/562; 222/326
(58) Field of Search ..... 222/326, 327, 222/541.5, 562

(56) References Cited

U.S. PATENT DOCUMENTS

| | | | | | |
|---|---|---|---|---|---|
| 2,754,033 | A | * | 7/1956 | Etter | 222/326 |
| 3,486,503 | A | | 12/1969 | Porter et al. | 128/239 |
| 3,858,739 | A | * | 1/1975 | Turner et al. | 215/47 |
| 3,930,599 | A | | 1/1976 | Brothers et al. | 222/143 |
| 4,213,546 | A | * | 7/1980 | Massey | 222/546 |
| 4,284,213 | A | | 8/1981 | Lee | 222/541 |
| 4,408,699 | A | * | 10/1983 | Stock | 222/149 |
| 5,104,013 | A | | 4/1992 | Hawley | 222/566 |
| 5,154,327 | A | * | 10/1992 | Long | 222/326 |
| 5,301,843 | A | | 4/1994 | Groene et al. | 222/192 |
| 5,370,271 | A | * | 12/1994 | Segatz | 222/95 |
| 5,379,927 | A | * | 1/1995 | Montenieri et al. | 222/546 |
| 5,897,009 | A | * | 4/1999 | O'Meara | 215/48 |
| 2003/0127472 | A1 | * | 7/2003 | Doherty et al. | 222/541.5 |

* cited by examiner

*Primary Examiner*—Joseph A. Kaufman
(74) *Attorney, Agent, or Firm*—Harpman & Harpman

(57) ABSTRACT

A secondary closure adapted to be resealingly engaged over the elongated open dispensing spout extending from a caulking tube cartridge. The closure includes a spout receiving area which conforms to and seals against the extended continuous exterior surface of the spout maintaining an airtight seal to prevent the hardening of air curable material within. The resealing closure also provides for the imparting of exterior mechanical forces upon its base for rotation and removal or resealing being integral with the body of the closure. The closure interior dimensions are such that a progressive sealing action is achieved as the closure is distortably engaged longitudinally over the dispensing spout of a uniformed tapered exterior surface.

6 Claims, 4 Drawing Sheets

DEFORMABLE RESEALING CLOSURE FOR CAULKING CARTRIDGES

BACKGROUND OF THE INVENTION

1. Technical Field

This invention relates to conventional caulking cartridges that have a generally tubular body member with a movable sealing disk at one end and an integral dispensing spout in oppositely disposed relation thereto. Such caulking cartridges are used to dispense a wide variety of materials by allowing for controlled dispensing rate through the dispensing spout which is cut open unsealing the cartridge for use. Typically a caulking "gun" is used to hold and apply incremental pressure to the movable disk, forcing the contents out through the dispensing spout.

2. Description of Prior Art

Prior art devices of this type have been directed to solving the problem of resealing an open tube of caulk material when all of the inner contents is not initially used. Heretofore a variety of make shift methods have been used such as inserting a nail or screw into the nozzle, wrapping the nozzle with plastic film or tape in an effort to prevent air from drying out the air curable material within the nozzle.

Prior art patents have disclosed a number of sealing devices, see for example U.S. Pat. Nos. 3,486,503, 3,930,599, 4,284,213, 5,104,013, and 5,301,843.

In U.S. Pat. No. 3,486,503 a two-piece nozzle assembly is disclosed having a screw on base nozzle with an overlying closure cap. The cap has a nozzle insert stud and a pair of spaced annular sealing beads associated therewith.

U.S. Pat. No. 3,930,599 discloses a cap for caulking cartridges wherein a cap is engaged over the entire end of the tube with a secondary interior nozzle engagement spout receiver positioned within to seal the spout.

U.S. Pat. No. 4,284,213 claims a closure and nozzle system in which a threaded nozzle has a snap on cap that also can be inverted and threadably inserted into the tube in place of the nozzle for sealing of same.

A caulking tube nozzle adapter is disclosed in U.S. Pat. No. 5,104,013 having a series of inter-engageable cap elements that are selectively secured to one another and on the tube nozzle to provide a selection of nozzle tip openings of different sizes.

Finally, U.S. Pat. No. 5,301,843 discloses a combination caulking tube cap and application device having a sealing cap portion with a dispensing spreading surface portion used to smooth the dispensed bead of caulking material.

SUMMARY OF THE INVENTION

A closure resealing apparatus for dispensing tubes of air curable materials. A resealing cap is provided to reseal the container after opening by providing a true airtight seal between the nozzle and the interior of the cap. The resealing cap has a flexible trans-annular distortable portion that extends longitudinally over a corresponding tapered elongated surface portion of the nozzle for continuous seal there between.

DESCRIPTION OF THE PREFERRED EMBODIMENT

Figure 1:
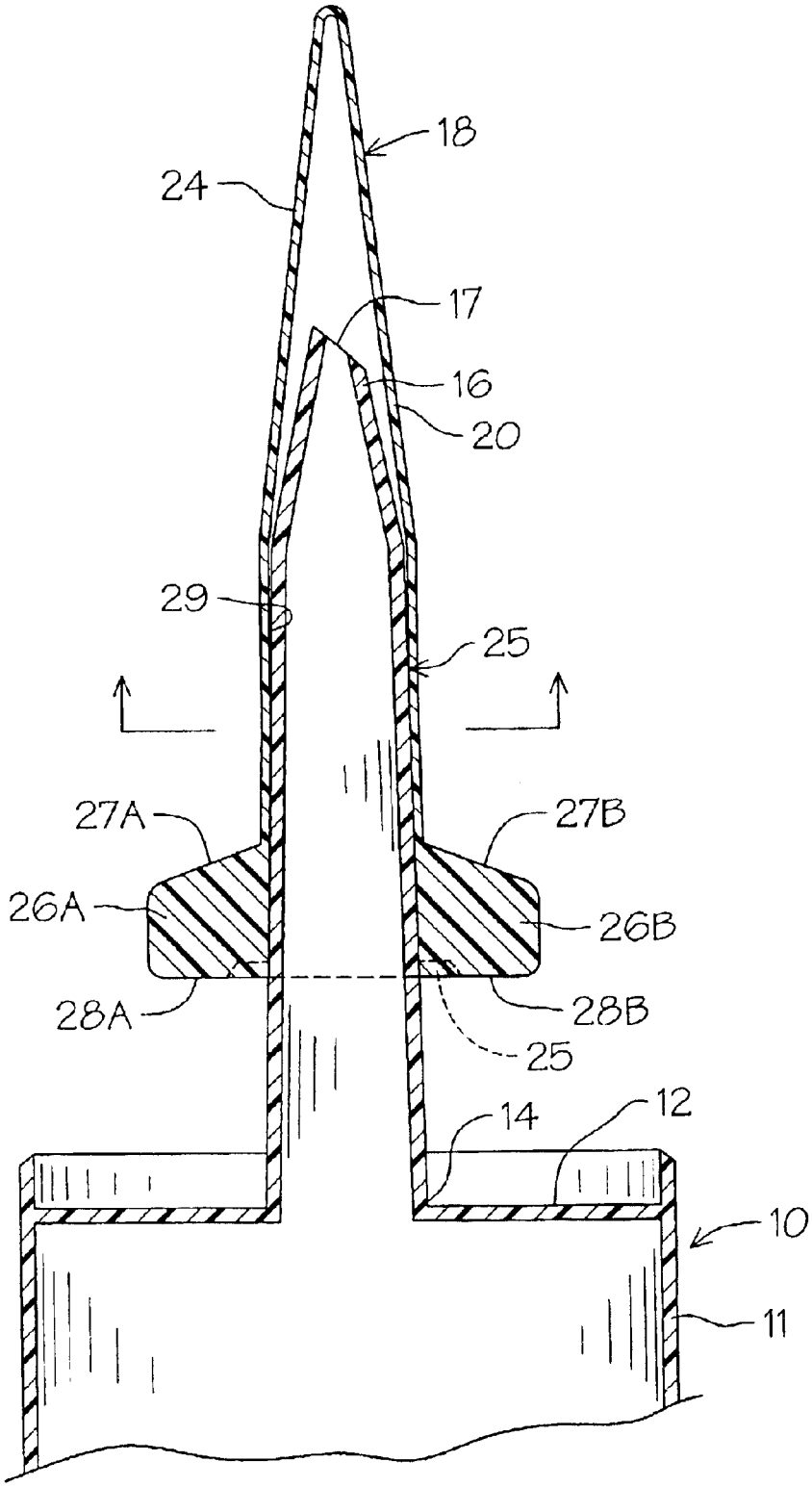
FIG. 1 is a partial cross-sectional view of the resealing cap of the invention on a dispensing tube.

Referring to FIG. 1 of the drawings, a caulking cartridge 10 can be seen having an annular sidewall 11 with an end wall 12. A dispensing nozzle 13 extends integrally from the end wall 12 having a base portion 14 with a tapered cylindrical wall 15 extending there from. The cylindrical wall 15 is continuously tapered to a point inwardly of its distal end which has a conical tip portion 16 extending there from. The nozzle 13 is illustrated with an open end at 17 in which a portion of the tip 16 has been cut away for use as will be well understood by those skilled in the art.

A resealing cap 18 of the invention is positioned over the dispensing nozzle 13 forming an elongated continuous airtight seal there between as will be described in greater detail hereinafter.

Figure 3:
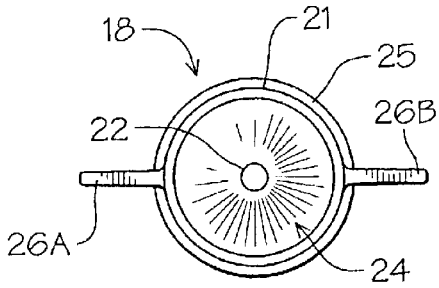
FIG. 3 is a top plan view of the resealing cap of the invention.
Figure 4:
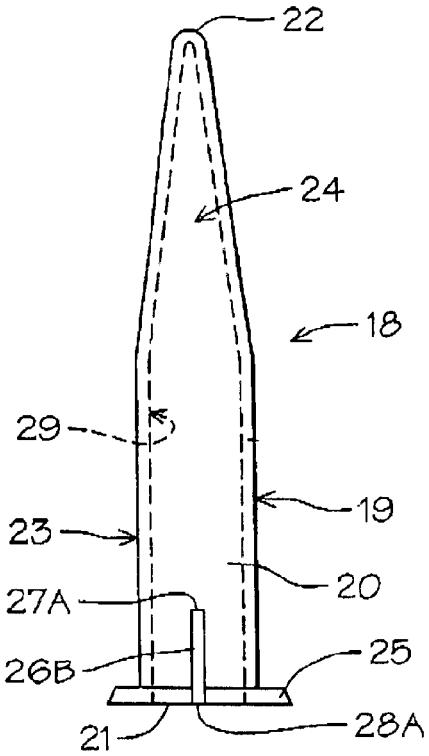
FIG. 4 is a side elevational view of the resealing cap of the invention.

The sealing cap 18 has a hollow body member 19 defined by an annular sidewall 20 with an open engagement end 21 and an oppositely disposed closed end 22. The hollow body member 19 has a cylindrical sealing portion 23 and a tapered end portion 24 extending there from. The cylindrical sealing portion 23 has an annular flange 25 extending about the open engagement end 21, best seen in FIGS. 2, 3 and 4 of the drawings. A pair of oppositely disposed placement and removal tabs 26A and 26B extend integrally from the open engagement end 21 upwardly along a portion of the cylindrical sealing portion 23, as best seen in FIG. 1 of the drawings. The tabs 26A and 26B are identical and have tapered upper edges 27A and 27B respectively and horizontally disposed lower edges 28A and 28B respectively in parallel relation with the end wall 12.

Figure 2:
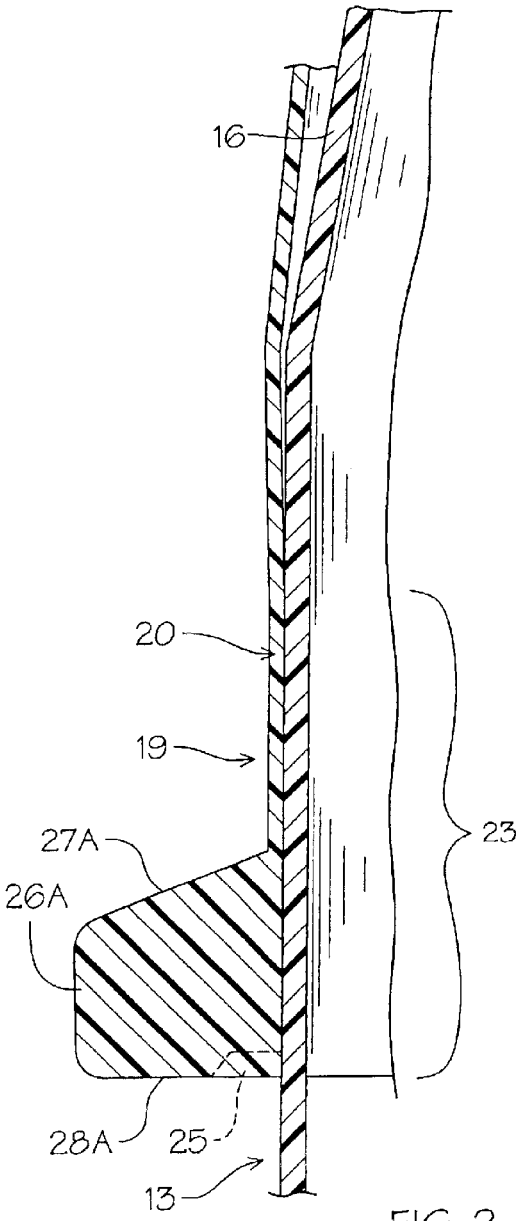
FIG. 2 is an enlarged partial cross-sectional view of the resealing cap engagement surface area of the dispensing nozzle.
Figure 5:
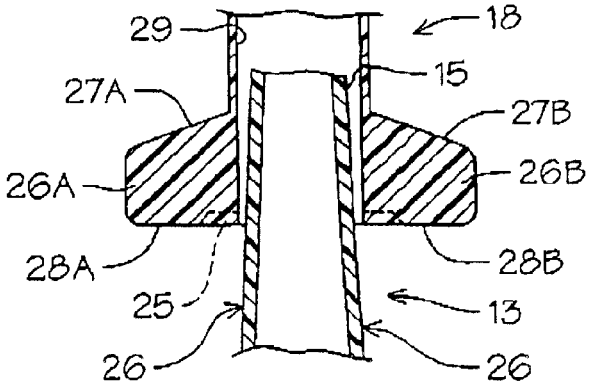
FIG. 5 is a partial cross-sectional view of the resealing cap initially engaged on a dispensing nozzle.
Figure 6:
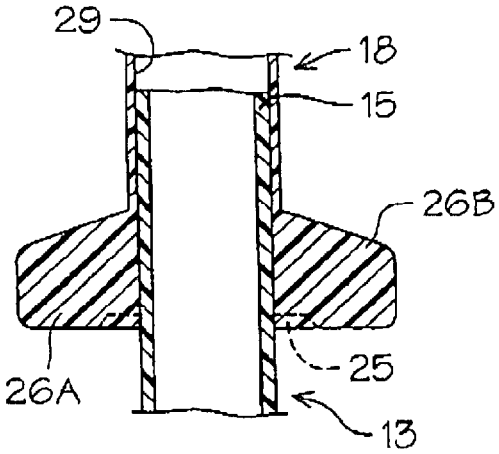
FIG. 6 is a partial cross-sectional view of the resealing cap partially engaged on the nozzle.
Figure 7:
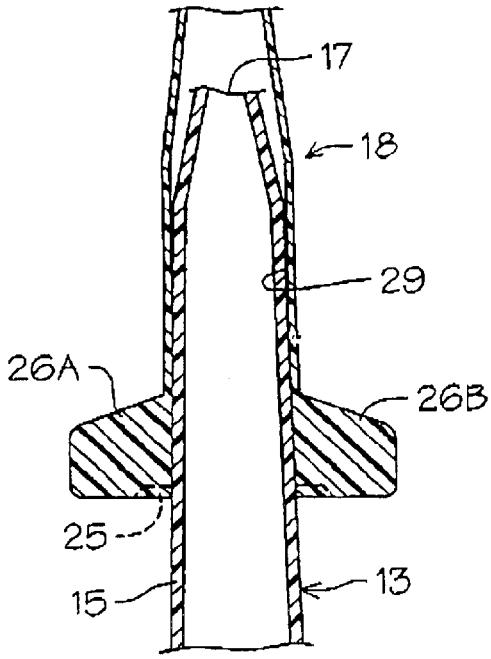
FIG. 7 is a partial cross-sectional view of the resealing cap of the invention fully engaged in sealing relationship on the dispensing nozzle.

The resealing cap 18 is preferably made of a flexible synthetic resin material with a dimensional capability of annular distortion under applied force. To engage and seal the open dispensing nozzle 13 hereinbefore described the resealing cap 18 is positioned initially over the conical tip portion 16 of the nozzle 13 and advanced thereon by engagement of the tabs 26A and 26B as illustrated generally in FIGS. 5–7 of the drawings. As the resealing cap 18 is advanced, it will first engage a portion of the nozzle's tapered cylindrical wall 15 exterior's surface 26 at a point inwardly of the conical tip portion 16 as illustrated in FIG. 5 of the drawings. As the resealing cap 18 continues to be advanced it will distort and conform with the increasing diameter of the nozzle's tapered cylindrical wall 15 as illustrated in FIG. 6 of the drawings. Once final placement of the cap 18 has occurred as defined when the cap 18 can no longer be longitudinally engaged further on the nozzle 13 a true longitudinally extending airtight seal will have been achieved between a distorted interior surface 29 of the cylindrical sealing wall portion 23 of the cap 18 and an exterior surface 26 of the dispensing nozzle as best seen in FIG. 2 of the drawings at S1.

The annular flange 25 reinforces the base of the cap 18 so as to force a trans-annular longitudinally distortion of the hollow body 19 and specifically the cylindrical sealing portion 23 of the annular sidewall 15 as hereinbefore described.

To remove the resealing cap 18 of the invention, the tabs 26A and 26B as noted provide tactile interface to rotate and pull the resealing cap 18 from sealing engagement with the dispensing nozzle 13 and removal there from.

It will be evident from the above description that cross-sectional thickness of the resealing cap 18 and specifically that of the cylindrical sealing portion 23 and its specific synthetic resin material chosen will provide for the unique annular and longitudinal distortion required for an effective engagement over a comparatively rigid exterior surface 26 of the nozzle 13 imparting a frictional coefficient there between that provides a sealing relation thereto.

It will thus be seen that a new and novel resealing closure for a caulking tube nozzle has been illustrated and described and it will be apparent to those skilled in the art that various changes and modifications may be made therein without departing from the spirit of the invention.

Therefore I claim:

1. A closure for resealing a dispensing caulking cartridge nozzle, said closure comprises, a resilient elongated cap having a cylindrical sealing portion and a tapered enclosure end portion, said cylindrical sealing portion having a continuous parallel sidewall including an inner and outer periphery surfaces and an annular base flange defining an opening, said tapered enclosure end portion having a continuous conical sidewall with a closed end, a pair of oppositely disposed tabs extending from said cylindrical sealing portion in engaged relation to said tapered enclosure end portion, said closure axially received over the distal end of said cartridge nozzle, said inner periphery surface of said cylindrical sealing portion resiliently conforming to the coplanar outer surface of said cartridge nozzle defining an elongated annular seal there between, said cylindrical sealing portion is of a uniform transverse dimension.

2. The closure set forth in claim 1 wherein said sidewall of said cylindrical sealing portion is of a reduced transverse dimension so as to be deformable under annular applied pressure thereto upon engagement upon a continuous tapered surface to the inner periphery surface.

3. The closure set forth in claim 1 wherein said oppositely disposed tabs extend from said annular base flange inwardly along said outer cylindrical sealing portion surface.

4. The closure set forth in claim 1 wherein said closure is axially engaged over said dispensing spout from a first surface contact position to a second sealing position.

5. The closure set forth in claim 4 wherein said second closure position defines a continuous elongated annular seal between said dispensing spout and said inner peripheral surface of said cylindrical sealing portion from said annular base flange to a point in spaced relation to said respective tabs and said tapered enclosure end portion.

6. The closure set forth in claim 1 wherein said tabs define tactile mechanical force input applied surfaces.

* * * * *